United States Patent [19]

Thuries et al.

[11] Patent Number: 4,945,198

[45] Date of Patent: Jul. 31, 1990

[54] HIGH TENSION CIRCUIT BREAKER WITH LOW OPERATING ENERGY

[75] Inventors: Edmond Thuries, Meyzieu; Denis Dufournet, Bron; Michel Perret, Bourgoin-Jallieu, all of France

[73] Assignee: Societe anonyme dite: ALSTHOM, Paris, France

[21] Appl. No.: 327,883

[22] Filed: Mar. 23, 1989

[30] Foreign Application Priority Data

Mar. 23, 1988 [FR] France ..... 88 03803

[51] Int. Cl.[5] ..... H01H 33/88

[52] U.S. Cl. ..... 200/148 A; 200/148 R

[58] Field of Search ..... 200/148 R, 148 A

[56] References Cited

U.S. PATENT DOCUMENTS 4,880,946 11/1989 Thuries et al. ..... 200/148 A

*Primary Examiner*—Robert S. Macon

*Attorney, Agent, or Firm*—Sughrue, Mion, Zinn, Macpeak & Seas

[57] ABSTRACT

A high tension circuit breaker containing a dielectric gas under pressure, the circuit breaker being of the type comprising at least one interrupting chamber comprising an insulating envelope filled with said gas and containing a fixed assembly including a fixed main contact (2) and a fixed arcing contact (4), and a moving assembly including a moving main contact (7) and a moving arcing contact (5), the interrupting chamber also containing a pair of secondary contacts and a blast cylinder opening out into a blast nozzle. The circuit breaker further includes first means (37, 38,104) for limiting the maximum separation distance between the secondary contacts to a value which is less than the maximum separation distance between the arcing contacts, and second means (60, 101) for preventing any arcs being struck during closure.

9 Claims, 4 Drawing Sheets

HIGH TENSION CIRCUIT BREAKER WITH LOW OPERATING ENERGY

The present invention relates to a high tension circuit breaker in which the interrupting chamber is filled with a dielectric gas such as sulfur hexafluoride, and in which the energy of the arc is used to reduce the energy required for interrupting by taking advantage of the increase in pressure that the arc confers on the gas.

BACKGROUND OF THE INVENTION

The invention relates more particularly to a circuit breaker having a blast cylinder and a second chamber in which an additional pair of contacts is capable of generating a secondary arc during circuit breaker opening, with the secondary arc being used to provide energy for the opening operation.

Such a circuit breaker is described, for example, in published French patent No. 2 610 763.

A problem that needs to be solved in this type of circuit breaker is that the pressure in the blast cylinder is low when interrupting small currents (low operating energy) and that the pressure is high when interrupting large currents without there being a corresponding increase in the available operating energy.

This problem has been partially solved in published German application No. 23 49 263.

In this document, provision is made to maintain the pressure in the blast cylinder at a low value by providing the blast piston with closable openings.

The circuit breaker described in the above-mentioned document nevertheless suffers from drawbacks. In the prior art circuit breaker the maximum separation distance between the secondary contacts is as long as the separation distance between the arcing contacts causing the secondary arc to be drawn out lengthwise, thereby giving rise to arcs being struck on the walls of the chamber containing the secondary contacts.

This type of arcing impedes good current interruption and increases the rate of the circuit breaker wear.

A first object of the invention is to provide a circuit breaker in which the secondary arc does not strike further arcs.

In the prior art circuit breaker, no steps are taken to prevent an arc being struck when the circuit breaker is closed. However, such arcing increases the operating energy required and gives rise to additional circuit breaker wear.

Another object of the invention is to provide a circuit breaker in which no arc is struck during circuit breaker closing.

SUMMARY OF THE INVENTION

The invention provides a high tension circuit breaker containing a dielectric gas under pressure, the circuit breaker being of the type comprising at least one interrupting chamber comprising an insulating envelope filled with said gas and containing a fixed assembly including a fixed main contact and a fixed arcing contact, and a moving assembly including a moving main contact and a moving arcing contact, the interrupting chamber also containing a pair of secondary contacts and a blast cylinder opening out into a blast nozzle, wherein the circuit breaker includes first means for limiting the maximum separation distance between the secondary contacts to a value which is less than the maximum separation distance between the arcing contacts, and second means for preventing any arcs being struck during closure.

BRIEF DESCRIPTION OF THE DRAWINGS

Embodiments of the invention are described by way of example with reference to the accompanying drawings, in which.

DETAILED DESCRIPTION

Figure 1:
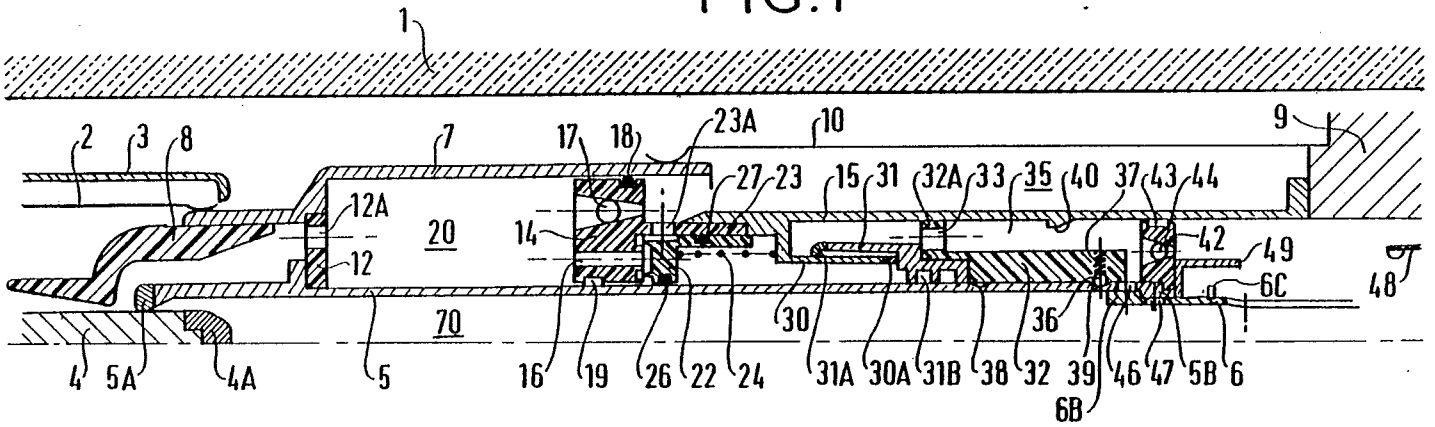
FIG. 1 is a fragmentary axial half section through the interrupting chamber of a circuit breaker in accordance with the invention, shown in the closed position.

FIG. 1 shows an interrupting chamber comprising an outer envelope 1 of insulating material such as a ceramic, filled with a dielectric gas such as sulfur hexafluoride at a pressure of a few bars. Inside the envelope, there is a fixed assembly comprising a fixed main contact constituted by contact fingers 2 protected by an anti-corona cap 3, and an arcing contact constituted by a metal tube 4 terminated by an end 4A made of an alloy which withstands the effects of arcing.

The moving equipment includes a metal tube 5 acting as a moving arcing contact and terminated by an end-piece 5A made of an alloy which withstands the effects of arcing.

The tube 5 is driven by a metal tube 6, e.g. an aluminum tube, which is fixed to an operating rod (not shown). The tubes 5 and 6 are not fixed to each other. On the contrary, a degree of lost motion is provided between them, with drive being conveyed via two steps 5B and 6B on the tubes 5 and 6. The lost motion is limited by an abutment 6C.

A metal tube 7 disposed concentrically around the tube 5 acts as the moving main contact.

It carries a blast nozzle 8 made of insulating material. Contact fingers 10 put it in electrical contact with a metal block 9 which is fixed to the fixed equipment and which is made of aluminum, for example.

The tube 5 and the tube 7 are fixed together by an insulating ring 12 which is pierced by holes 12A.

The volume 20 delimited by the tubes 5 and 7 is closed by a fixed system 14 made of an insulating material such as polytetrafluoroethylene, and which is held in place by a metal tube 15 fixed to the block 9.

Reference 20 designates the volume delimited by the tubes 5 and 7, the ring 12, and the piston 14. This volume constitutes the blast cylinder of the circuit breaker.

The piston 14 is pierced by orifices 16 and includes a non-return valve 17 which allows gas to pass only from the outside towards the inside of the volume 20. The piston 14 includes a sealing piston rod 18 and a guide ring 19.

The orifices 16 of the piston 14 may be closed by an annular piston 22 mounted to slide in the annular space constituted by the tube 5 and a cylindrical extension 23 of the piston 14, said extension being pierced by holes 23A. The annular piston 22 is thrust against the orifices 16 by a spring 24 bearing against a portion which is fixed to the fixed tube 15. The piston is sealed by means of piston rings 26 and 27.

An auxiliary pair of contacts comprises:

a fixed tubular contact 30 which is fixed to the tube 15 and which is provided with an end 30A of material suitable for withstanding an arc; and a tubular contact 31 which is provided with an expendable wear end 31A, which is fixed to a guide block 32 of insulating material, and which is provided with sliding contacts 31B cooperating with the tube 5.

The insulating block is guided in the annular space lying between the tubes 5 and 15 by means of a portion 32A bearing against the tube 15.

This portion is provided with orifices 33 in order to allow gas to pass freely into the volume 35 lying between the tube 15 and the parts 31, 32, and 42.

Insulating part 32 is provided with a catch system, e.g. comprising balls 36 and springs 37 co-operating with grooves 38 and 39 formed in the tube 5. An abutment 40 of the tube 15 limits the stroke of the insulating part 32.

The volume 35 is closed by an insulating piston 42 which is fixed to the tube 5 and which has a guide segment 43 and a non-return valve 44 allowing gas to pass only from the outside towards the inside of the volume 35.

The end of the tube 5 has holes 46. Similarly, the tube 6 has holes 47.

The part 9 carries a contact 48 which co-operates with an and 49 of the tube 5 in order to place the tube 5 at the same potential as the remainder of the moving equipment at the end of an opening stroke.

The circuit breaker operates as follows.

When the circuit breaker is closed (the position shown in FIG. 1), current passes via the fingers 2, the tubes 7, and fingers 10, and the part 9.

Interrupting Low Currents

Figure 2:
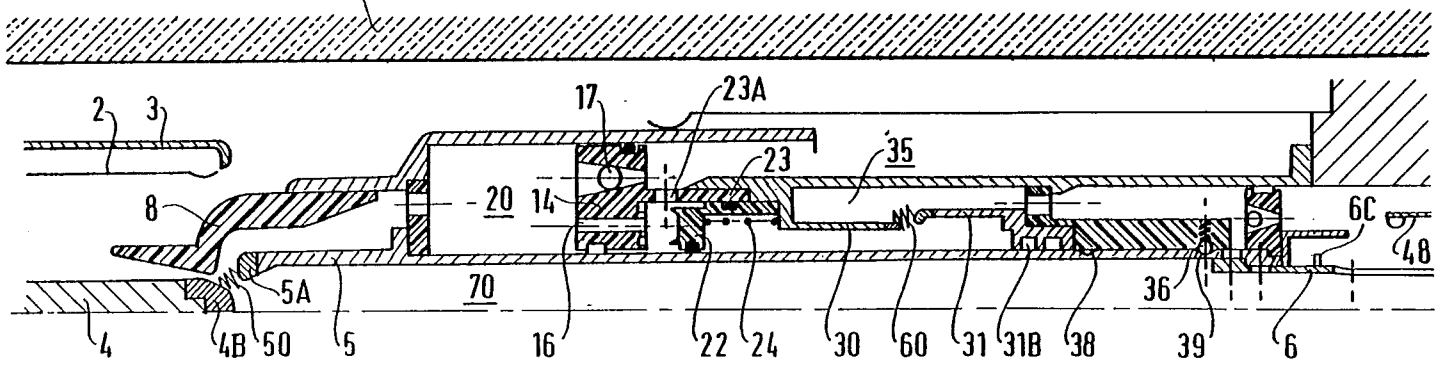
FIG. 2 is a similar view while opening to interrupt a low current.

These are currents which are not greater than the nominal current of the insulation. When the circuit breaker is opened (FIG. 2), the moving equipment is driven by the tube 6. When the contacts separate, an arc 50 is struck between the arcing contacts 4B and 5A. The increase in pressure in the chamber 20 thrusts back the piston 22 against the action of the spring 24 such that the pressure in the chamber remains constant and low with the gas expanding easily through the holes 16 and 23A.

The suction generated in the volume 35 opens the nonreturn valve 44 so pressure is maintained inside the volume 35. There is thus no loss by suction.

The arc 60 which occurs between the contacts 30 and 31 either simultaneously with the arc 50 or slightly before or slightly after, gives rise to an increase in pressure which is sufficiently small to avoid disturbing this operation.

Before the current is interrupted by the action of the contacts moving apart, the current flows via the contact 4, the arc 50, the tube 5, the contacts 31B, the contact 31, the arc 60, the contact 30, the tube 15, and the part 9.

Figure 3:
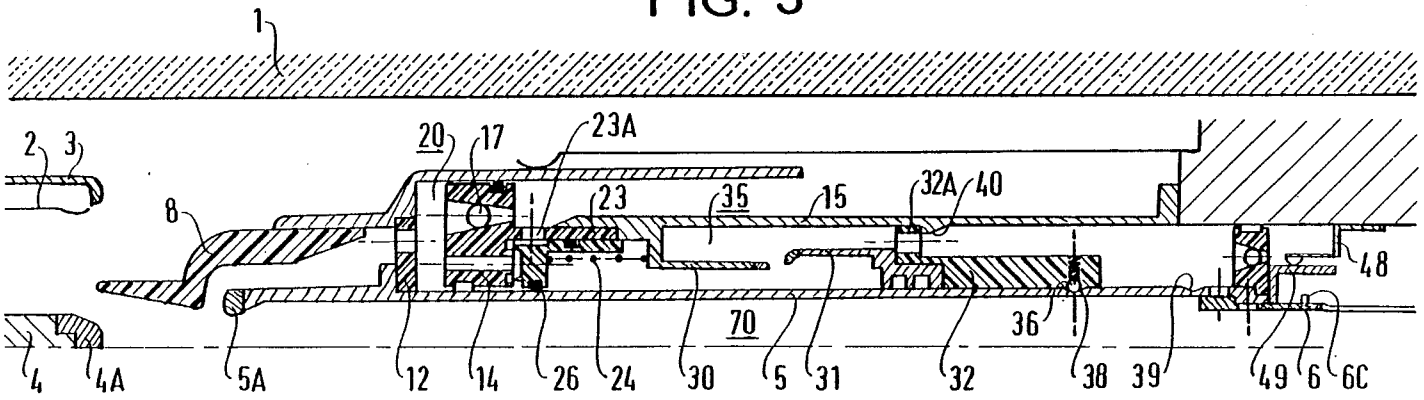
FIG. 3 is a similar view showing the end of the opening operation.

After a length of stroke which is determined as a function of the short circuit current, the part 32A comes into abutment against the part 40. The tube 5 continues its stroke, with the balls 35 escaping from the groove 39 and taking up position in the groove 38 (FIG. 3) at the end of the interrupting operation, and the slight increase in pressure in the volume 20 is lost via the holes 23A. The piston 22 comes back into abutment against the fixed piston 14. The contact 48 puts the end 49 of the tube 5, and thus also the contact 31, to the same potential as the part 9, the tube 15, and thus the contact 30.

It can be seen that by virtue of the dispositions of the invention, the maximum separation distance between the secondary contacts remains less than the separation distance between the arcing contacts, and as a result there is no risk of additional arcing to be feared from the secondary arc being drawn out to too far.

Closing the Circuit Breaker

Figure 4:
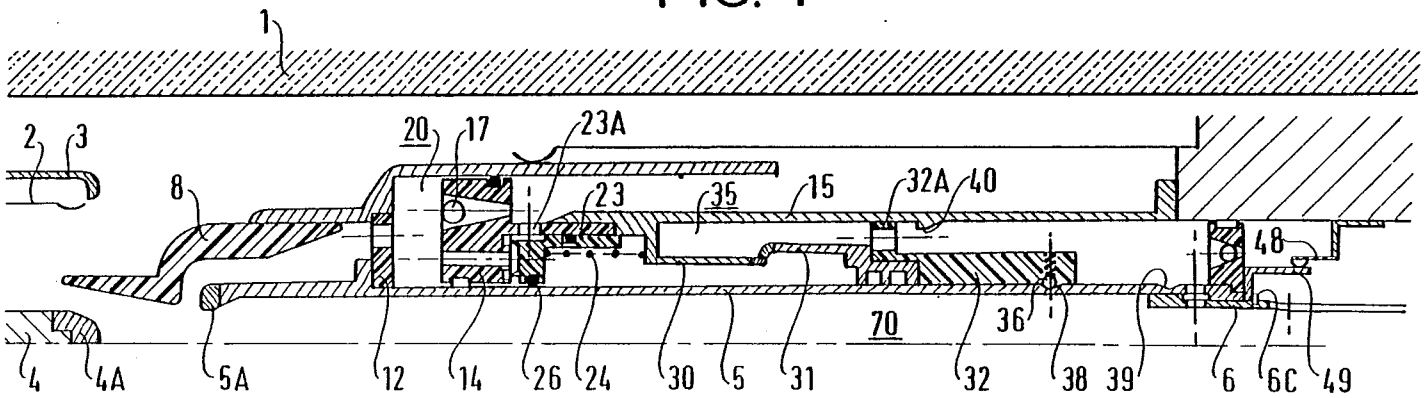
FIG. 4 is a similar view showing the circuit breaker being closed.

The tube 6 is driven to the left in the figure (FIG. 4). The abutment 6C drives the tube 5 and the contacts 30 and 31 make contact without creating an arc since they are at the same potential by virtue of contact between the parts 48 and 49. The slight increase in pressure inside the volume 3 escapes into the volume 70 inside the tube 5 via the holes 46 and 47 when they come into coincidence. When the contact 30A comes into abutment against the block carrying the contact 31, the balls 36 leave the groove 38 and take up position again in the groove 39 at the end of the closure operation.

At the end of the closure operation, the circuit breaker is back in the configuration shown in FIG. 1.

It can be seen that by virtue of the disposition of the invention, there is no possibility of arcs being struck during closure of the circuit breaker.

Any resistance that could arise due to a possible drop of pressure in the chamber 20 is avoided by the non-return valve 1 opening.

Interrupting High Currents

High current means a short circuit current.

Figure 5:
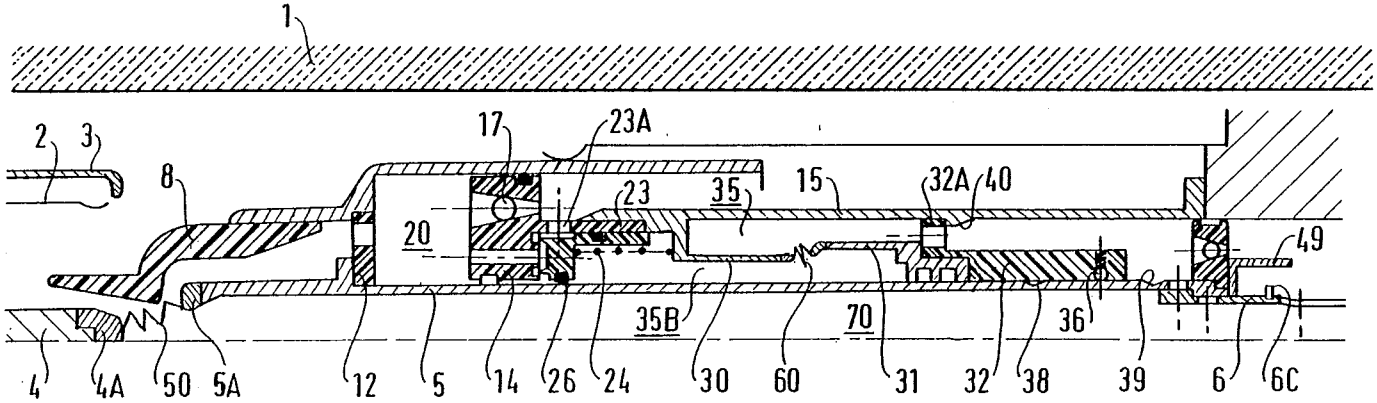
FIG. 5 is a similar view showing the circuit breaker being opened on a high current.

FIG. 5 shows the circuit breaker during an opening operation with the tube 6 being moved to the right in the figure.

The arc 60 is of very high intensity, thereby rapidly heating the volume 35 and the volume 35B surrounded by the contacts 30, 31, the piston 22, and the cylinder 5.

The resulting increase in pressure has two effects:

the first effect is to thrust the piston 22 against the piston 14, thereby closing off any communication between the volume 35B and the volume 20. The increasing pressure in the volume 20 enhances the possibility of the primary arc 50 being extinguished by auto-blast, itself enhanced by the reduction of size in the volume 20 due to the moving equipment 5, 7 moving relative to the fixed piston 14; and the second effect is to exert pressure on the insulating piston 42, thereby contributing to the energy available for the operation.

To do this, the hot gas of the volume 35 passes through the orifices 33 of the part 32A.

After such an interruption operation on a high current, the circuit breaker is reclosed in the same manner as described above under the heading: closing the circuit breaker. The holes 46 and 47 move back into coincidence and excess pressure in the volume 35 is evacuated into the volume 70.

Figure 6:
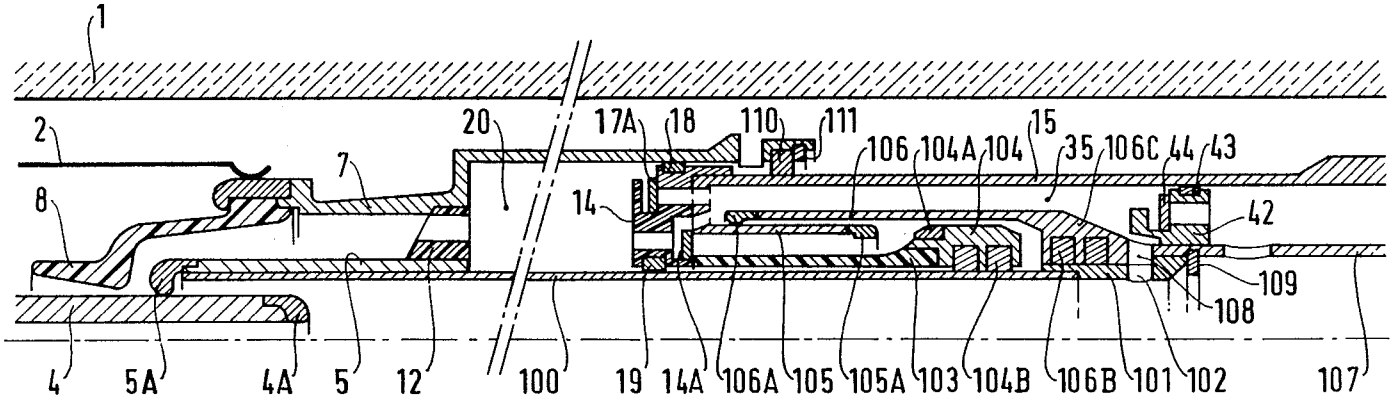
FIG. 6 is a fragmentary half section through a variant circuit breaker in accordance with the invention.

FIG. 6 shows a variant embodiment. Items which are common to this figure and to the preceding figures have been given the same reference numerals.

There can be seen the ceramic envelope 1, the fixed main contacts 2, the fixed arcing contact 4, 4A, the moving main contact 7, and the moving arcing contact 5, 5A which is fixed to a tube 100 which is in turn fixed to a short solid tube 101 provided with radial holes 102.

There can also be seen the piston 14 provided with its sealing rings 18 and 19 and fixed to the fixed tube 15. The piston is provided in this case with simple non-return valves 14A and 17A.

An insulating tube 103 is fixed to the piston 14, with the tube being terminated by a metal part 104 provided with an expendable wear part 104A and in contact with the tube 100 via sliding electrical contacts 104B. The insulating tube 103 is advantageously provided with grooves parallel to the axis of the circuit breaker for channeling the secondary arc. The first secondary contact 105 is provided with an expendable wear part 105A and is fixed to the tube 15, while the second secondary contact 106 is provided with an expendable wear part 106A and is moveable relative to the tube 101 and is extended by a tubular part 107 in turn connected to a circuit breaker operating rod (not shown). The contact 106 has a solid part 106C provided with radial orifices 108 which come into coincidence with the holes 102 when the circuit breaker is closed (the position shown in FIG. 6). The part 106C has sliding electrical contacts 106B co-operating with the part 101. An abutment 109 such as a spring clip fixed to the rod 107 comes into abutment against the part 101 during a closing operation.

The moving main contact 7 carries sliding electrical contacts 110 for passing current through the part 15 which, as before, is connected to one of the terminals of the circuit breaker. An abutment 111 limits the stroke of the moving equipment on closing. As in FIGS. 1 to 5, the chamber 35 is closed by an insulating piston 42 provided with a guide segment 43 and a non-return valve 44.

The circuit breaker operates as follows:

when in the closed position, current passes via the fingers 2, the tube 7, the contacts 110, and the tube 15; and the orifices 102 and 108 are in coincidence; and when the circuit breaker is opened, the tube 107 is pulled to the right in the figure and it drives the contact 106 whose solid part 106A begins by closing the orifices 102, and then drives the part 102 and consequently the arcing contact 5.

An arc appears at substantially the same time both at the arcing contacts and at the secondary contacts.

However, as soon as the end 106A reaches the part 104A, the secondary arc is lengthened no further and remains fixed between these two parts. As a result there is no risk of arcs being struck inside the chamber 35 due to the secondary arc being excessively drawn out. When the circuit breaker is closed, the rod 107 moves the contacts 105 and 106 towards each other prior to any relative motion between the contacts 4 and 5.

As a result, the secondary contacts are closed before the arcing contacts and there can therefore be no arcing during closure.

The circuit breaker of the invention requires only a small amount of operating energy regardless of the value of the current to be interrupted. The number of parts is small and they are all bodies of revolution which means that they are cheap to manufacture and they can be assembled quickly and easily. The design of the circuit breaker eliminates any risk of unwanted arcs being struck.

We claim:

1. A high tension circuit breaker containing a dielectric gas under pressure, the circuit breaker being of the type comprising at least one interrupting chamber comprising an insulating envelope filled with said gas and containing a fixed assembly including a fixed main contact and a fixed arcing contact, and a moving assembly including a moving main contact and a moving arcing contact, the interrupting chamber also containing a pair of secondary contacts and a blast cylinder opening out into a blast nozzle, wherein the circuit breaker includes first means for limiting the maximum separation distance between the secondary contacts to a value which is less than the maximum separation distance between the arcing contacts, and second means for preventing any arcs being struck during closure.

2. A circuit breaker according to claim 1, wherein said blast cylinder is delimited by a first tube constituting the moving arcing contact, a second tube constituting the fixed main contact, and a fixed piston, the first tube and a second tube which is connected to the fixed assembly and which is concentric with said first tube together delimiting a variable volume on the other side of the piston closing the blast cylinder, which variable volume is closed on one side by a closure piston and on its other side by an annular end piston connected to said first tube and sliding along said second tube, said volume enclosing said secondary contacts, a first secondary contact being fixed to said second tube and a second secondary contact being driven by said first tube, the second secondary contact being constrained to move between first and second fixed positions along said first tube.

3. A circuit breaker according to claim 2, wherein the second secondary contact is provided with catch means co-operating with grooves formed in said first tube in order to hold said second secondary contacts in said fixed positions.

4. A circuit breaker according to claim 1, wherein the fixed assembly carries a contact coming into contact with the moving arcing contact when the circuit breaker is open.

5. A circuit according to claim 1, wherein the piston closing the blast cylinder includes a non-return valve allowing gas to pass only from the outside towards the inside of said cylinder.

6. A circuit breaker according to claim 1, wherein said annular end piston includes a non-return valve allowing gas to pass only from the outside towards the inside of the volume containing the secondary contacts.

7. A circuit breaker according to claim 1, wherein the tube constituting the moving arcing contact is connected to a drive tube with a degree of lost motion being allowed therebetween so as to enable holes through the tube constituting the moving arcing contact to be put into coincidence with holes provided through said drive tube when the circuit breaker is reclosed in order to evacuate excess pressure in the volume containing the secondary contacts.

8. A circuit breaker according to claim 1, wherein said blast cylinder is delimited by a first tube and by a third tube disposed concentrically with said first tube delimiting a volume on the other side of the piston closing said blast cylinder, said volume containing secondary contacts with one of said secondary contacts being a tube fixed to said third tube and with the other one of said secondary contacts being connected to the operating rod of the circuit breaker which is moveable relative to said moving arcing contact and carrying an abutment for driving said moving contacts, a metal part which is fixed relative to said piston and which is in electrical contact with the moving arcing contact, being disposed in said volume in such a manner that the length of the secondary arc is limited.

9. A circuit breaker according to claim 8, wherein said metal part is fixed to said piston by a tubular insulating part provided with grooves running parallel to the axis of the circuit breaker.

* * * * *